US005246483A

United States Patent [19]

Streets

[11] Patent Number: 5,246,483

[45] Date of Patent: Sep. 21, 1993

[54] SLAG SEPARATOR

[75] Inventor: Frederick T. Streets, Sidney, Ohio

[73] Assignee: Honda of America Manufacturing, Inc., Marysville, Ohio

[21] Appl. No.: 899,372

[22] Filed: Jun. 16, 1992

[51] Int. Cl.[5] ..... C21B 3/04

[52] U.S. Cl. ..... 75/582; 266/227; 266/232

[58] Field of Search ..... 75/582; 266/227, 232

[56] References Cited

U.S. PATENT DOCUMENTS

| | | | |
|---|---|---|---|
| 3,565,605 | 2/1971 | Vayssiere | 75/582 |
| 3,702,695 | 11/1972 | Rouanet | 75/582 |
| 4,274,622 | 6/1981 | Ohmori | 75/582 |
| 5,004,495 | 4/1991 | Labate | 75/582 |

OTHER PUBLICATIONS

Prepared under the direction of the ASM International Handbook Committee, "Metals Handbook Ninth Edition vol. 15 Casting", 1988.

*Primary Examiner*—Peter D. Rosenberg
*Attorney, Agent, or Firm*—Ronald P. Kananen

[57] ABSTRACT

An apparatus and method are disclosed for receiving molten slag and molten metal or alloy resulting from the smelting of ore from a cupola and for separating the slag from the molten metal or alloy. The slag separator of the present invention includes a refracting lining to protect the separator from the mechanical, chemical and thermal properties of the molten mixture. During the process of separation, the refractory however, suffers from erosion due to the mechanical, chemical and thermal properties of the mixture. A water cooling jacket is provided on the outside of the refractory to reduce refractory erosion and greatly increase refractory life. In addition, the separator is provided with two chambers which allow the slag to rise to the top of the metal or alloy. The slag then flows out of the chambers. The use of two chambers greatly increases the purity of the metal or alloy by allowing almost all of the slag to settle out of the metal or alloy.

22 Claims, 4 Drawing Sheets

SLAG SEPARATOR

FIELD OF THE INVENTION

This invention re to a system for separating different substances and more particularly to a cupola slag separator for separating molten slag from molten metal or alloy-still more particularly, this invention relates to a slag separator for a dry bottom cupola used in an iron casting foundry.

BACKGROUND OF THE INVENTION

A cupola is a cylindrical shaft furnace that burns coke, ore or scrap steel and limestone, intensified by the blowing of air through tuyeres to create a molten metal or alloy such as iron. Slags are also created along with the metal or alloy as a result of the smelting of ore. Alternate layers of ore, limestone and coke are charged into the top of the cupola. As the ore descends, the ore is melted by direct contact with the countercurrent flow of hot gases from the coke combustion. The resulting molten metal or alloy collects in the well of the cupola where it is discharged for use by intermittent tapping or by continuous flow. The slag, being lighter than the metal or alloy, rises to the top of the tapped mixture. The slag is skimmed off the top of the molten metal or alloy after the mixture is discharged through the tap hole.

In a dry bottom cupola, the metal or alloy and slag are not collected in the well of the cupola but are forced by blasts of air into a special vessel outside and beside the cupola to separate the slag from the metal or alloy. Inside the separator the slag rises to the top of the molten metal or alloy. The slag is then siphoned off through a slag exit hole which is maintained about 2–3 inches higher than a metal or alloy exit hole. The conventional slag separator consists of one chamber which receives the molten metal or alloy and slag.

The conventional slag separator, however, when used with a dry bottom cupola fails to remove all of the slag from the metal or alloy due to the turbulent stirring of the metal or alloy. As a result, the final product exiting from the conventional slag separator is not in a highly purified form. It is therefore a problem in the prior art to easily and completely separate metal or alloy, such as iron, from its slag.

In addition, due to the high temperature of the molten metal or alloy and slag, the conventional separator must be lined with a refractory to protect the separator against abrasion, heat and oxidation. It is a problem, however, that there is a great deal of mechanical and chemical attack on the refractory especially at the outlet from the cupola. As a result, the refractory wears out and must be frequently torn down, at least every two to five weeks, and the separator relined. This is not only costly but time consuming leading to a considerable amount of down time during which the cupola and its separator cannot be used. Thus, it is also a problem to provide a separator which does not require frequent replacement of the refractory or significant down time.

Moreover, the use of hot air to force the molten metal or alloy and slag into the separator prevents the operator from removing the top of the separator to inspect the state of the refractory and to make spot repairs. The top must remain in place to protect the operator from the hot air. Accordingly, inspection and repairs must be made when the separator is not running resulting in additional down time. Thus, it is also a problem in the prior art to provide a separator which can be opened and repaired by the operator while in use.

SUMMARY OF THE INVENTION

It is thus a general object of the present invention to provide a cupola slag separator which does not suffer from the problems and defects described above.

It is a further object of the present invention to provide a cupola slag separator which can be used with both wet and dry bottom cupolas which results in a final product of almost pure metal or alloy.

It is a further object of the present invention to provide a cupola slag separator which does not suffer from refractory erosion problems and significantly it increases the time between refractor replacements.

It is a further object of the present invention to provide a cupola slag separator on which the operator is able to make spot repairs and inspections while the separator is in use.

Additional objects, advantages and novel features of the invention will be set forth in the description which follows, and will become apparent to those skilled in the art upon reading this description or practicing the invention. The objects and advantages of the invention may be realized and attained by the appended claims.

To achieve the foregoing and other objects, in accordance with the present invention, as embodied and broadly described herein, the slag separator of the present invention comprises first and second settling chambers for sequentially receiving the metal or alloy and slag mixture from a cupola and allowing the slag to rise to the top of the metal or alloy; a refractory material lining the chambers to protect the chambers from mechanical, thermal or chemical characteristics of the molten mixture; cooling means surrounding the refractory material to reduce the temperature of the refractory material and reduce the erosion of the refractory material; and means for removing the slag separated from the metal or alloy from the first and second chambers.

In use, the slag separator according to the invention is positioned adjacent a tap hole at the bottom of the cupola. An iron/slag mixture is admitted to the first settling chamber of the slag separator, where slag is skimmed off the iron. The skimmed mixture then passes beneath a chamber divided to the second settling chamber where additional slag is collected at the top of the chamber for skimming.

Preferably the slag separator is water cooled by a jacket surrounding the refractory so that the refractory is preserved. The separator is also preferably positioned above grade, so that the air space beneath the separator assists its cooling.

BRIEF DESCRIPTION OF THE DRAWINGS

The accompanying drawings, which are incorporated in, and form part of, the specification, illustrate an embodiment of the present invention, and together with the description serve to explain the principles of the invention. In the drawings.

DETAILED DESCRIPTION OF THE PREFERRED EMBODIMENT

Reference will now be made in detail to the preferred embodiment of the invention, an example of which is illustrated in the accompanying drawings.

Figure 1:
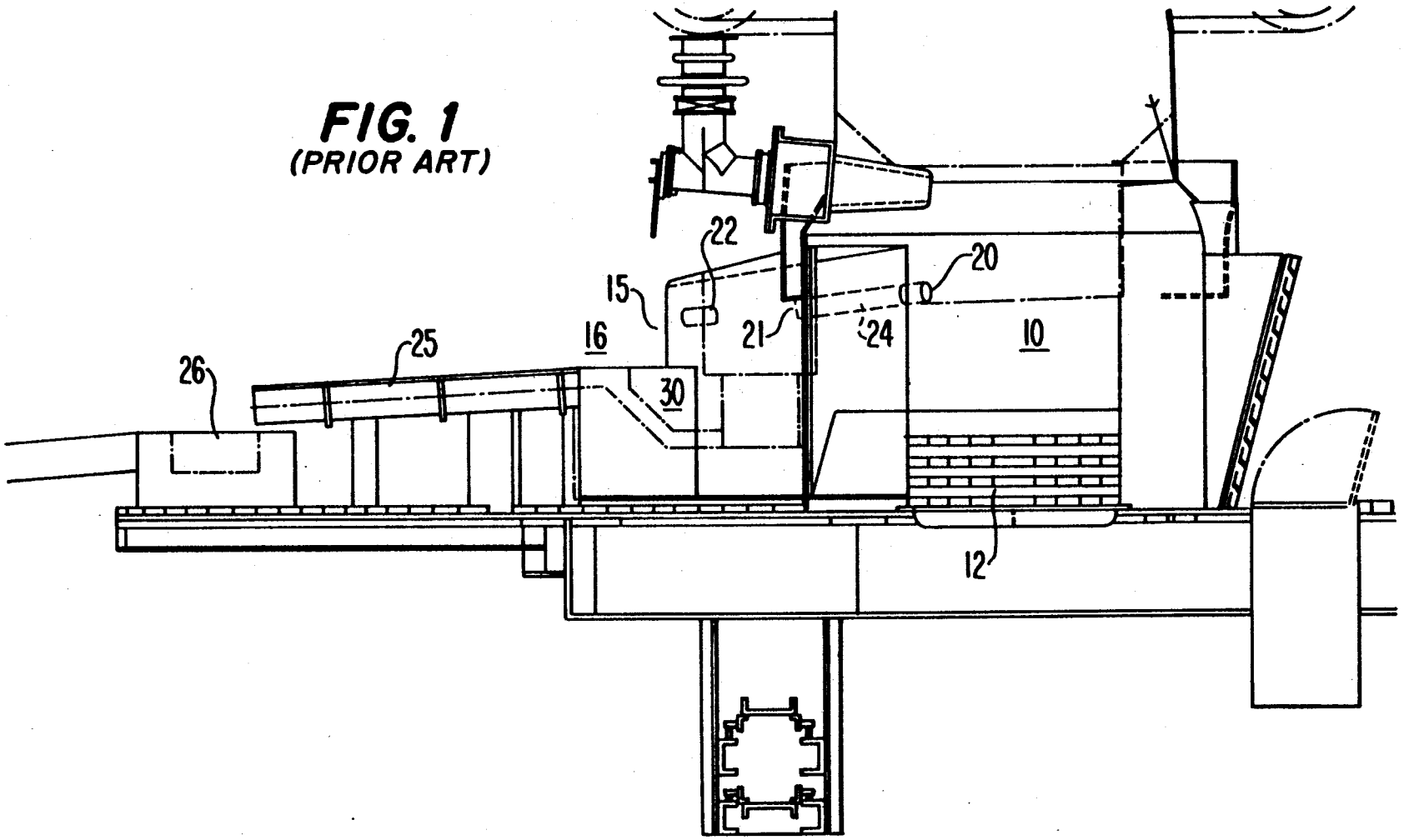
FIG. 1 (PRIOR ART)
FIG. 1 is a view of the cupola and slag separator of the prior art.
Figure 2:
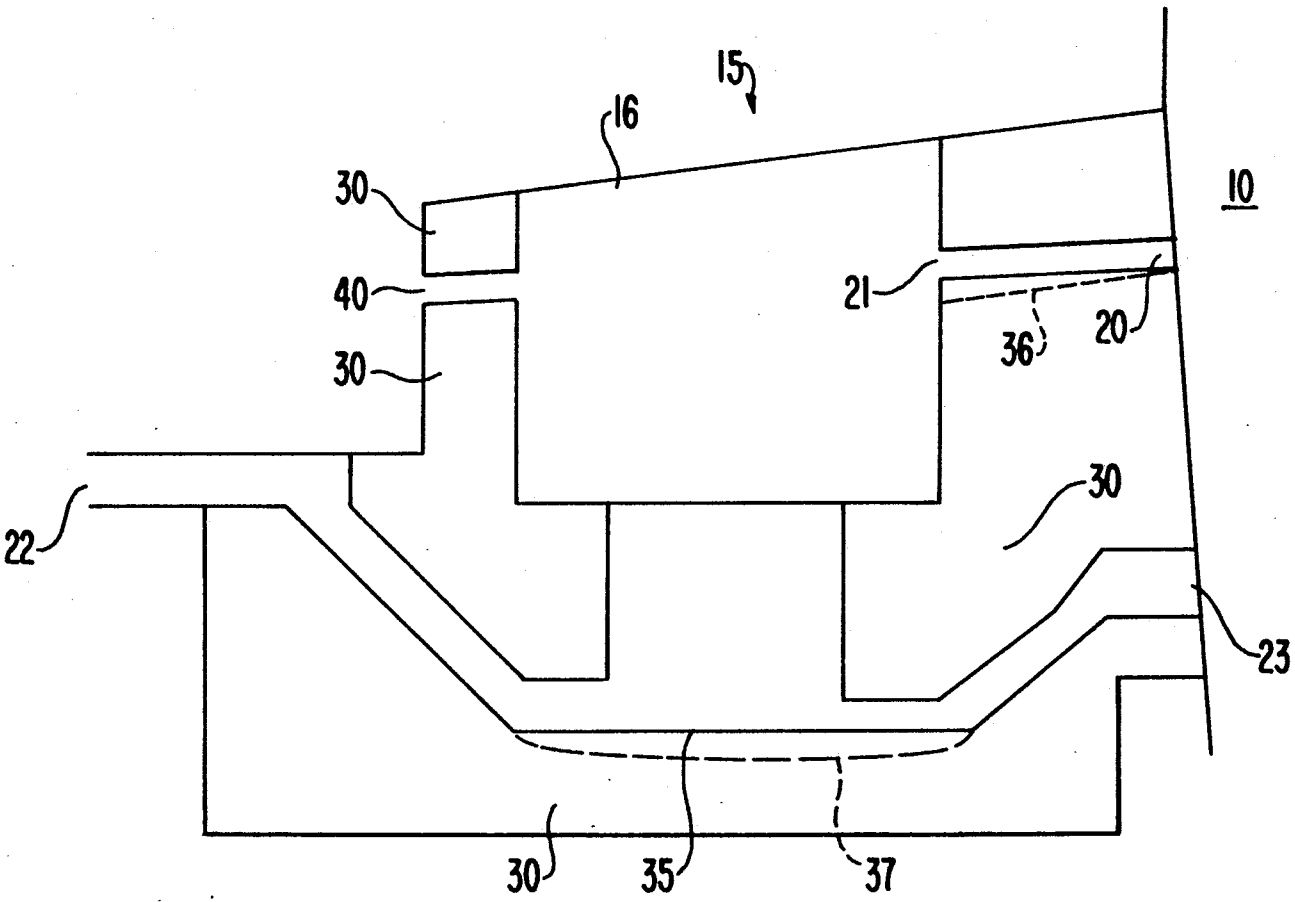
FIG. 2 (PRIOR ART)
FIG. 2 is a view of another slag separator of the prior art.

Illustrated in FIGS. 1 and 2 is a slag separator of the prior art. The base of a dry bottom cupola 10 is shown at 12 in FIG. 1. The molten metal or alloy and slag that accumulates in the base 12 of the cupola 10 during the smelting of iron ore exits the cupola through a tap hole 20 and travels through an insulated passageway 24 into a slag separator 15 at an entrance 21. The slag separator 15 is integrally formed with the base of the cupola without external cooling.

Because the molten metal or alloy is heavier than the slag, once in the separator, the slag rises to the top of the metal or alloy and flows out of the separator through a slag extraction opening 22 as the metal or alloy and slag flow through the separator 15. The molten metal or alloy exits the separator through a metal or alloy exit hole 23 to a runner 25 and then to a ladle 26. The slag extraction opening 22 is maintained higher than the metal or alloy exit hole 23 to allow the slag to flow off the top of the metal or alloy as it flows through the separator 15.

A refractory 30 lines the entire separator to protect the separator and the operator from the heat of the molten metal or alloy and slag, oxidation, and chemical attack. Erosion of the refractory occurs throughout its length due to the high temperature of the molten slag and metal and the oxidative and chemical forces acting on the separator, but is especially acute at the entrance 21 and at a bottom area 35 at the bottom of the separator 15 due to the mechanical forces of the molten metal and slag operating on the separator at these points. These erosion points are shown at reference numerals 36 and 37 in FIG. 2. The cupola 10 shown in FIG. 2 is tapped at tap hole 20 and the molten metal or alloy and slag enter the separator 15 into a chamber 16 through the entrance hole 21. The slag flows out of the separator chamber 16 through the slag exit hole 22 and metal or alloy leaves the separator chamber 16 through the metal or alloy exit hole 23. An overflow hole is also provided a shown at 40 which allows overflowing slag and metal or alloy to exit the cupola.

Figure 3:
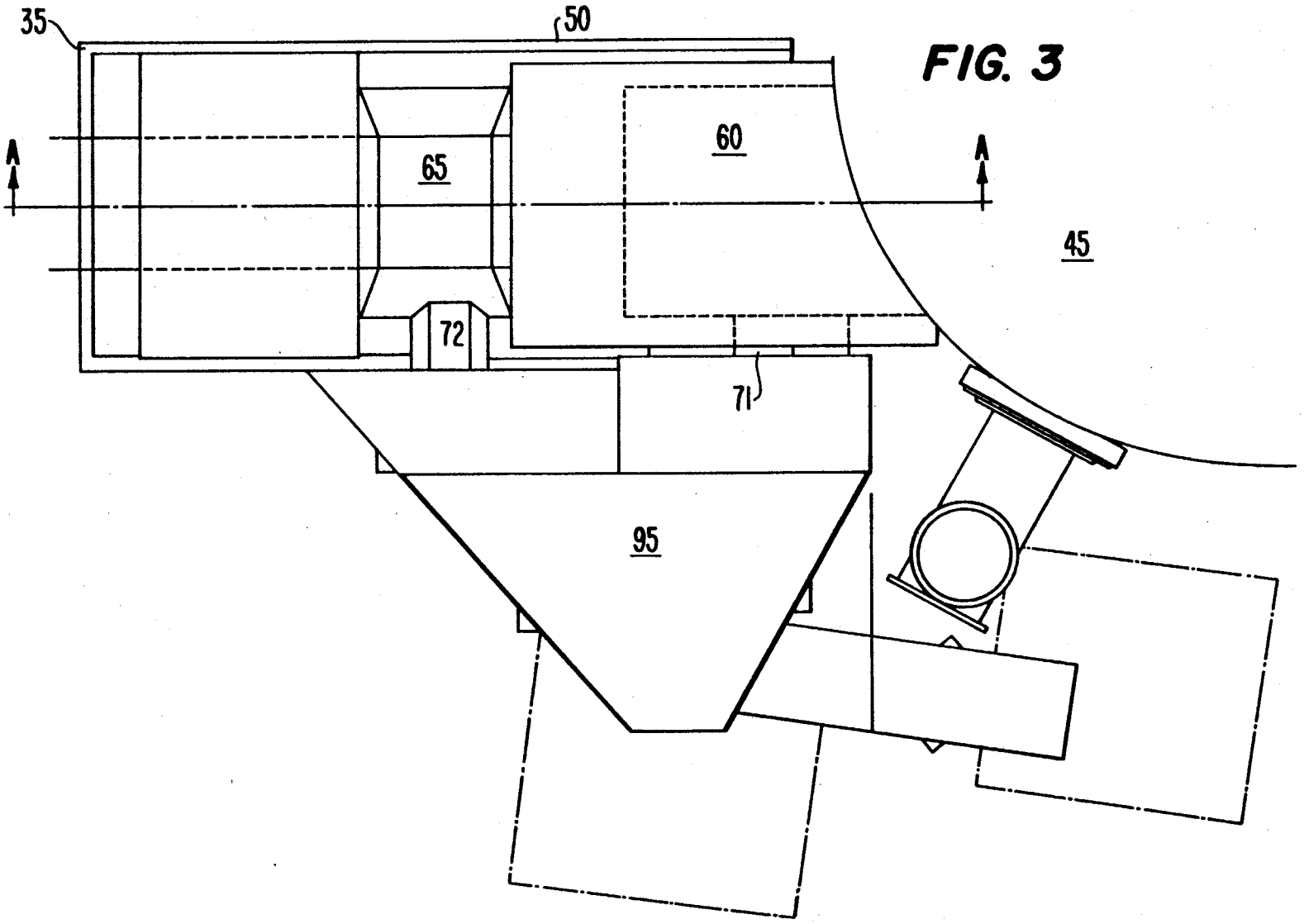
FIG. 3 is a top plan view of the cupola and slag separator of the present invention.
Figure 4:
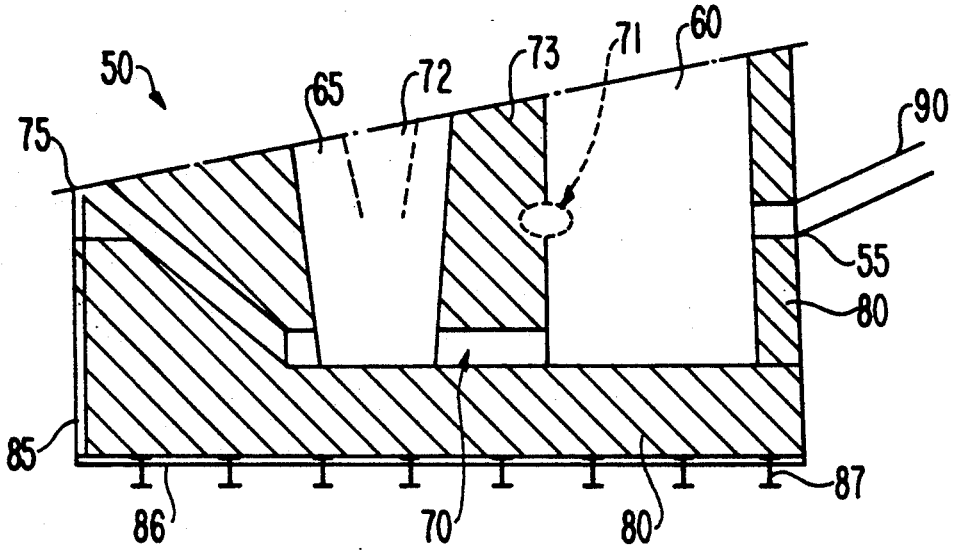
FIG. 4 is a side view of the slag separator of FIG. 3 taken along line A—A of FIG. 3.

The cupola slag separator of the present invention is illustrated in FIGS. 3 and 4 at reference numeral 50. FIG. shows a top plan view of the slag separator of the present invention. FIG. 4 shows a side view of the slag separator taken on line A—A of FIG. 3.

The slag separator 50 is connected to a cupola 45 by way of passageway 90 which allows the molten metal or alloy and slag mixture from the cupola to flow into a first chamber 60 of the separator 50 through an inlet 55. The separator 50 is supported by I-beams 87, or any other suitable support means, to provide a base for the separator and an air passage for air to pass underneath the separator to aid in cooling.

The molten metal or alloy, being heavier than the slag, settles to the bottom of the mixture and the slag rises t the top in the first chamber 60. The slag which is on top of the metal or alloy flows out of the separator through a first slag exit hole 71 to a slag conveyor 95 as the mixture flows through the separator 50. The first slag exit 71 is shown perpendicular to the inlet 55 in FIG. 4. The molten metal or alloy mixture then passes from the first chamber 60 to a second chamber 65 through metal or alloy passageway 70. In the second chamber 65, the metal or alloy is able to settle a second time and a significant portion of any slag remaining in the mixture after the first separation rises to the top of the metal o alloy and flows out of the separator through a second slag exit 72 to the slag conveyor 95. The remaining metal or alloy which is almost entirely free of slag flows out of the separator through the metal or alloy exit 75 to a runner and ladle similar to the one shown in FIG. 1. The two separation chambers allow the slag and metal or alloy mixture to settle twice resulting in almost all of the slag being separated from the metal or alloy.

According to the principles of the invention, additional settling chambers could be used with respectively common or separate slag and iron separation.

The entire slag separator 50 including a wall 73 between the chambers 60 and 65 and paths is lined with a refractory 80 which can be any suitable material such as, but not limited to, fireclay brick or block. As described in connection with FIGS. 1 and 2, the refractory of the prior separators must be replaced every two to three weeks because the refractory is eroded by abrasion, heat, and oxidation. The present invention, however, solves the problems of the prior art by including water cooling jackets shown at 85 and 86 surrounding the shell of the separator.

Figure 5:
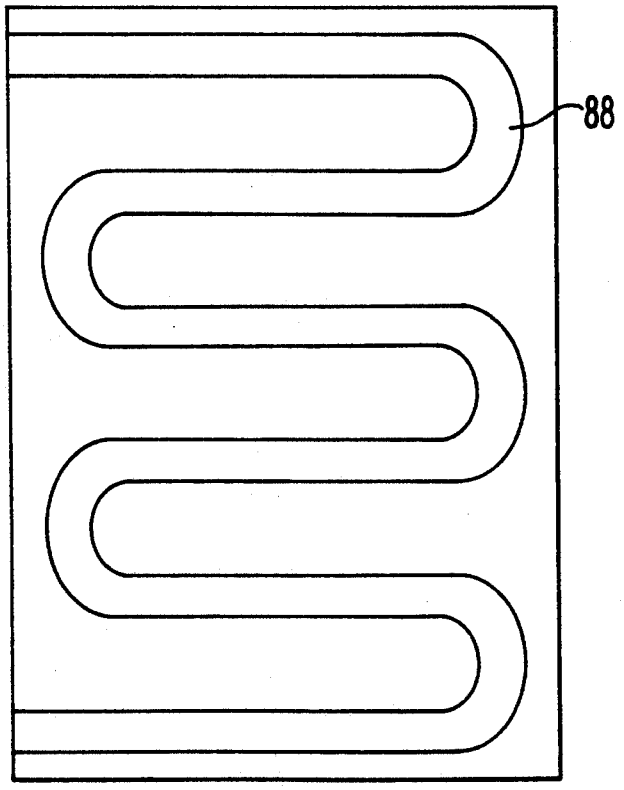
FIG. 5 is a plan view of the water cooling jacket used in the slag separator of the present invention.

The water cooling jackets on each of the side surfaces and the bottom surface keep the outside layer of the refractory lining cooler thereby greatly reducing the amount of erosion found in non-cooled systems and increasing refractory life. The refractory cooled by the water cooling jackets 85 and 86 of the present invention need not be replaced sooner than twenty weeks as opposed to two to three weeks in the prior systems. A representative plan view of a water cooling jacket is shown in FIG. 5. As shown in FIG. 5 the water cooling jackets include serpentine water pipes 88, however, any suitable water cooling means or configuration could be used.

In addition, the water cooling jackets 85 and 86 keep the outside of separator sufficiently cool to the touch and prevents operators or others from being burned by contact with the separator. The jackets 85 and 86 are able to operate with fresh or recycled water. Although not necessary to extending the life of the refractory, the reduced temperature of the refractory caused by the water cooled jackets additionally causes slag to solidify on the inside layer of the refractory thereby further insulating the refractory and extending refractory life.

The molten metal or alloy and slag travels through the separator 50 under the force of gravity. The inlet 55 is attached to cupola tap hole through passageway 90. The passageway is sloped at such an angle so as to allow the force of gravity and the weight of the molten material to drive the material through the separator. The sloped passageway 90 eliminates the need to utilize blasts of hot air to facilitate a flow of the molten materials from the cupola through the slag separator 50. Because this system does no use blasts of hot air, the operator can remove the top of the separator and the passageway to make spot repairs and inspections while the cupola and separator are in operation.

The separator 50, while shown in conjunction with a dry bottom cupola, can also be used with a wet bottom cupola. In addition the separator can be used with a cupola that is tapped either continuously or intermittently.

The foregoing description of a preferred embodiment of the invention has been presented for purposes of illustration and description. It is not intended to be exhausted or to limit the invention to the precise form disclosed. Many modifications and variations are possible in light of the above teaching. The embodiment was chosen and described in order to best explain the principles of the invention and its practical application to thereby enable other skilled in the art to best utilize the invention and various embodiments and with various modifications as are suited to the particular use contemplated. It is intended that the scope of the invention only be limited by the claims appended hereto.

I claim:

1. A slag separator for receiving a molten metal or alloy and slag mixture from a cupola and separating the metal or alloy from the slag comprising:

a settling means for receiving said molten metal or alloy and slag mixture from said cupola, said settling means comprising a first chamber in said settling means for receiving said metal or alloy and slag from said cupola in which said metal or alloy undergoes a primary separation from said slag by allowing said slag to rise up through said metal or alloy, and a second means in said settling chamber for receiving said metal or alloy from said first chamber in which slag remaining in said metal or alloy after said primary separation is finally separated from said metal or alloy by allowing the unseparated slag remaining in said metal or alloy to rise up through said metal or alloy, and a passageway connecting said first and second chambers, said first chamber having a slag exit through which slag separated from the metal or alloy during said primary separation flows out of the first chamber of the separator, and said second chamber has a second slag exit through which the slag separated from the metal or alloy during said final separation flows out of the second chamber of the separator;

a refractory material lining said chamber to protect said chamber from mechanical, thermal, or chemical characteristics of said molten mixture; and fluid cooling means surrounding said refractory material to reduce the temperature of said refractory material to reduce the erosion of the refractory material caused by the mechanical, thermal, or chemical characteristics of the molten mixture, whereby a significant portion of slag remaining after said primary separation is separated from said metal or alloy in said second chamber so that remaining metal or alloy is nearly free of slag.

2. A slag separator as defined in claim 1, wherein said second chamber has a metal or alloy exit through which the metal or alloy which is finally separated from the slag flows out of the separator.

3. A slag separator as defined in claim 1, wherein said metal or alloy and slag flows through the separator by gravity.

4. A slag separator as defined in claim 3, wherein said settling means is connected to said cupola through a sloped passageway to allow said metal or alloy and slag to flow through the separator by gravity.

5. A slag separator as defined in claim 1 wherein said separator is supported by a frame which provides an air passage under the separator to aid in cooling.

6. A slag separator for receiving a molten metal or alloy and slag mixture from a cupola and separating the metal or alloy from the slag comprising:

a first settling chamber for receiving said metal or alloy and slag from said cupola and providing a primary separation of said metal or alloy from said slag in said first settling chamber by allowing said slag to rise up through said metal or alloy;

a first slag exit in said first settling chamber through which the slag separated from said metal or alloy during said primary separation flows out of the separator;

a second settling chamber for receiving said metal or alloy from said first chamber and finally separating said metal or alloy from said slag by allowing any slag remaining in said metal or alloy after said primary separation to rise up through said metal or alloy;

a passageway connecting said first and second chambers;

a second slag exit in said second settling chamber through which the slag separated from the molten metal or alloy during said final separation flows out of the separator; and a metal or alloy exit in said second chamber through which the metal or alloy which is finally separated from the slag flows out of the separator, whereby said first and said second chambers allow the slag and metal or alloy mixture to settle twice resulting in almost all of the slag being separated from the metal or alloy.

7. A slag separator as defined in claim 6 further comprising a refractory material lining said first and second chambers to protect said chambers from mechanical, thermal, or chemical characteristics of said mixture.

8. A slag separator as defined in claim 7 further comprising a fluid cooling means surrounding said refractory material to reduce the temperature of said refractory material to reduce the erosion of the refractory material caused by the mechanical, thermal, or chemical characteristics of the molten mixture.

9. A slag separator as defined in claim 6, wherein said metal or alloy and slag flows through the separator by gravity.

10. A slag separator as defined in claim 9, wherein said settling chambers are connected to said cupola through a sloped passageway to allow said metal or alloy and slag to flow through the separator by gravity.

11. A slag separator as defined in claim 6 wherein said separator is supported by a frame which provides an air passage under the separator to aid in cooling.

12. A process for separating molten metal or alloy from a mixture of molten metal or alloy and slag comprising the steps of:

providing a settling chamber for receiving said molten metal or alloy and slag mixture from said cupola lined with a refractory material to protect said chamber from mechanical, thermal, or chemical characteristics of said mixture;

directing said molten mixture of metal or alloy and slag into a separating chamber;

cooling said refractory material to reduce the temperature of said refractory material to reduce the erosion of the refractory material caused by the mechanical, thermal, or chemical characteristics of the molten mixture;

separating said metal or alloy from said slag;

removing said slag from said separating chamber; and removing said metal or alloy from said separating chamber, wherein the steps of separating the slag from the metal or alloy and removing said slag from the separating chamber further include the steps of:

primarily separating the slag from metal or alloy in a primary chamber is said settling chamber;

removing the slag separated during said primary separation from said primary chamber;

directing said metal or alloy from said primary chamber into a secondary separating chamber in said settling chamber;

finally separating any slag remaining in said metal or alloy after said primary separation from said metal or alloy; and removing the slag separated during said final separation from said secondary chamber, whereby nearly all of the slag is separated from said metal or alloy.

13. The process defined in claim 12 wherein the said mixture is directed into said settling chamber by gravity.

14. A process for separating molten metal or alloy from a mixture of molten metal or alloy and slag comprising the steps of:

directing said molten mixture of metal or alloy and slag from a cupola into a primary separating chamber having a first slag exit;

primarily separating the slag from metal or alloy in said primary separating chamber;

removing the slag separated during said primary separation from said primary chamber through said first slag exit;

directing said metal or alloy from said primary chamber into a secondary separating chamber having a second slag exit;

finally separating any slag remaining in said metal or alloy in said secondary separating chamber after said step of primarily separating from said metal or alloy;

removing the slag separated during said final separation from said secondary chamber through said second slag exit; and removing the metal or alloy from said secondary chamber, whereby nearly all of said slag is removed from said metal or alloy during said primary and said secondary separating steps.

15. The process defined in claim 14 further including the steps of:

lining said primary and secondary settling chambers with a refractory material to protect said chamber from mechanical, thermal, or chemical characteristics of said mixture; and cooling said refractory material to reduce the temperature of said refractory material to reduce the erosion of the refractory material caused by the mechanical, thermal, or chemical characteristics of the molten mixture.

16. The process defined in claim 14 wherein said mixture and metal or alloy is directed through the primary and secondary chambers under the force of gravity.

17. A slag separator as defined in claim 1 wherein said first slag exit is higher than said passageway connecting said first and second chambers.

18. A slag separator as defined in claim 5 wherein said second slag exit is higher than said metal or alloy exit from said second chamber.

19. A slag separator as defined in claim 1 wherein said first and said second chambers are separated by a refractory wall.

20. A slag separator as defined in claim 6 wherein said first slag exit is higher than said passageway connecting said first and second chambers.

21. A slag separator as defined in claim 20 wherein said second slag exit is higher than said metal or alloy exit from said second chamber.

22. A slag separator as defined in claim 6 wherein said first and said second chambers are separated by a refractory wall.

* * * * *